United States Patent [19]

Evans

[11] Patent Number: 4,566,546

[45] Date of Patent: Jan. 28, 1986

[54] SINGLE ACTING HYDRAULIC FISHING JAR

[76] Inventor: Robert W. Evans, Elkins Lake Box 428, Huntsville, Tex. 77340

[21] Appl. No.: 648,711

[22] Filed: Sep. 10, 1984

Related U.S. Application Data

[63] Continuation of Ser. No. 443,605, Nov. 22, 1982, abandoned.

[51] Int. Cl.[4] ..... E21B 4/14

[52] U.S. Cl. ..... 175/297; 166/178

[58] Field of Search ..... 175/297, 296, 293, 303; 166/178

[56] References Cited

U.S. PATENT DOCUMENTS 3,735,827 5/1973 Berryman ..... 175/296

3,851,717 12/1974 Berryman ..... 175/297

*Primary Examiner*—Stephen J. Novosad

*Assistant Examiner*—Thuy M. Bui

*Attorney, Agent, or Firm*—Neal J. Mosely

[57] ABSTRACT

A single acting hydraulic fishing jar, for use in a tubular drilling string for applying upward jarring forces for dislodging a "fish" from a well, may be run into a well on a drill string to operate a fishing tool in the well bore. The jar has housing members in telescoping relation for longitudinal movement of one relative to the other with a hammer member on one and an anvil member on the other. The housing members enclose a chamber containing an incompressible hydraulic fluid for controlling application of jarring forces. A sliding seal closes one end of the chamber and supports the inner housing member, i.e. mandrel, for sliding movement in the outer housing member. A piston is spaced from the sliding seal so that movement of one relative to the other. Movement of one housing relative to the other in one direction moves the piston toward the sliding seal. The chamber between the piston and the sliding seal has an outlet controlled by a valve member slidably supported for movement on the mandrel. Predetermined relative movement of the housing members engages and moves the valve member to open position permitting flow of fluid from the fluid chamber to substantially eliminate the resistance to further movement of the housing members and thus permit movement of a hammer member on the mandrel to impact an anvil member carried on the outer housing.

20 Claims, 11 Drawing Figures

SINGLE ACTING HYDRAULIC FISHING JAR

This is a continuation of application Ser. No. 443,605 filed on Nov. 22, 1982, now abandoned.

This invention relates to new and useful improvements in fishing jars and more particularly to single acting hydraulic fishing jars and the like.

BRIEF DESCRIPTION OF THE PRIOR ART

A fishing job, in oilfield terminology, means removing something from the well bore that does not belong there. What is removed is called a "fish" and may be part of a drilling string which has become stuck when drilling an oil or gas well, or may be production equipment being removed from an existing well bore during a workover or repair operation. The accepted method of retrieving a fish is to grab it by some means and push or pull an axial strain on it until something gives. A jar is a tool employed when either drilling or production equipment has become stuck to such a degree that a straight push or pull from the surface is insufficient to dislodge it.

The jar is normally placed in the pipe string in the region of the stuck object and allows the drilling rig operator at the surface to deliver an impact blow at the fish through manipulation of the drill pipe string. Jars contain a spline joint which allows relative axial movement between an inner mandrel or housing and an outer housing without allowing relative rotational movement.

The mandrel or inner housing contains an impact surface or hammer, which contacts a similar impact surface or anvil on the housing when the jar has reached the limit of axial travel. If these impact surfaces are brought together at high velocity, they transmit a very substantial impact to the fish due to the mass of the pipe above the jar.

Prior art jars are of three distinct forms, viz. hydraulic jars, mechanical jars and bumper jars. The bumper jar is used primarily to provide a downwardly directed impact blow. The bumper jar is usually a splined joint with sufficient axial travel allowed so that the pipe can be lifted and dropped, causing the impact surfaces inside the jar to come together to deliver a downward impact blow to the fish.

Mechanical and hydraulic jars differ from the bumper jar in that they contain a tripping mechanism which retards the motion of the impact surfaces relative to each other until an axial strain has been applied to the pipe. To jar upward, the pipe is stretched by an axial tensile pull applied at the surface. This tensile force is resisted by the tripping mechanism of the jar long enough to allow the pipe to stretch and store potential energy. When the jar "trips", this stored energy is converted to kinetic energy causing the impact surfaces of the jar to move together at a high velocity. Hydraulic and mechanical jars are much more efficient than bumper jars because they allow a much greater impact at the fish for a given pipe strain.

Mechanical jars are generally less versatile and reliable than hydraulic jars. One design of mechanical tripping mechanism requires that the tripping load be selected and preset at the surface to trip at one specific load. If it is desired to increase or decrease the tripping load, it is necessary to pull the pipe from the well bore, a costly and time consuming procedure. Another mechanical tripping mechanism of known configuration requires that torque be applied from the surface through the pipe to the tripping mechanism and that this torque be maintained while the jar trips. This can be dangerous to personnel on the rig floor and makes the tripping load difficult to control in deviated well bores. Another weakness of mechanical tripping devices is that they must be run in the cocked or detent position. Thus, the tripping mechanism is subjected to stresses during the normal course of drilling if it is run as a part of the bottom hole assembly. Mechanical tripping mechanisms have the additional disadvantage that the metallic parts must move relative to each other while under a high compressive load. This causes rapid wear and frequent failure of the moving parts.

Hydraulic tripping mechanisms are more desirable because they afford the versatility of a variable hitting load controlled only by the amount of axial strain applied at the surface. Also, hydraulic tripping mechanisms are less subject to mechanical deformation and wear than mechanical tripping mechanisms and therefore will work for a longer time under the same conditions.

The patent literature disclosing hydraulic jars has developed largely within the last thirty years.

Chenoweth U.S. Pat. No. 3,349,858 discloses a single acting (upward) hydraulic drilling jar in which the oil flow through the piston is controlled by a constant flow regulator valve.

Berryman U.S. Pat. No. 3,735,827 discloses a hydraulic fishing jar requiring a compressible hydraulic fluid. The mandrel is moved until the hydraulic fluid is compressed to a selected degree at which point a control valve engages an adjustable tripping abutment which opens the valve and dumps the pressurized fluid through a bypass to permit rapid movement of the hammer relative to the anvil surface.

Berryman U.S. Pat. No. 3,797,591 discloses a hydraulic fishing jar similar to U.S. Pat. No. 3,735,827 but including a different adjustable trigger mechanism.

Berryman U.S. Pat. No. 3,851,717 discloses a hydraulic fishing jar having a constant flow bypass for a tripping piston and arranged so that the tripping piston is moved down until the main bypass valve is opened and the device trips.

Berryman U.S. Pat. No. 4,059,167 discloses a fishing jar similar to Berryman U.S. Pat. No. 3,851,717 and incorporating a tandem piston arrangement to lower the internal operating pressure.

Young U.S. Pat. No. 3,285,353 discloses a fishing jar having telescoping mandrels, one connected to the drill string and the other to the drill fish, surrounded by an outer housing. A piston valve is arranged to dump pressure after a selected degree of movement and to move the housing to impact a hammer surface against an anvil surface.

Hazen U.S. Pat. No. 3,087,559 discloses a hydraulic fishing jar having mechanical trip fingers with a hydraulic delay.

SUMMARY OF THE INVENTION

One of the objects of this invention is to provide a new and improved fishing jar useful in earth drilling operations for removing stuck objects or "fish" from a drill hole.

Another object of this invention is to provide a new and improved hydraulically controlled and actuated fishing jar having an improved tripping mechanism.

Another object of this invention is to provide a new and improved single acting hydraulic fishing jar which can be recooked easily and operated again in the same direction.

Other objects of this invention will become apparent from time to time throughout the specification and claims as hereinafter related.

A new and improved single acting hydraulic fishing jar which achieves the above stated objectives is described below. A single acting hydraulic fishing jar is disclosed for use in a tubular drilling string for applying upward jarring forces for dislodging a "fish" from a well. The jar is adapted to be run into a well on a drill string and connected to a fishing tool in the well bore.

This jar comprises outer and inner housing members positioned in telescoping relation for longitudinal movement of one relative to the other and having a hammer member on one and an anvil member on the other. The housing members enclose a chamber adapted to contain a fluid for controlling application of jarring forces. A sliding seal closes one end of the chamber and supports the inner housing member, or mandrel, for sliding movement in the outer housing member. A piston is positioned in spaced relation to the sliding seal for movement of each relative to the other in the hydraulic fluid chamber. The piston is arranged so that movement of one housing relative to the other in one direction will move the piston toward the sliding seal.

The chamber between the piston and the sliding seal has an outlet controlled by a valve member supported for sliding movement on the mandrel. Predetermined relative movement of the housing members engages the valve member to move it to open position to permit flow of fluid from the fluid chamber to substantially eliminate the resistance to further movement of the housing members and thus permit movement of a hammer member carried by the mandrel into engagement with an anvil member carried on the outer housing with an impact force.

DESCRIPTION OF A PREFERRED EMBODIMENT

Figure 1A:
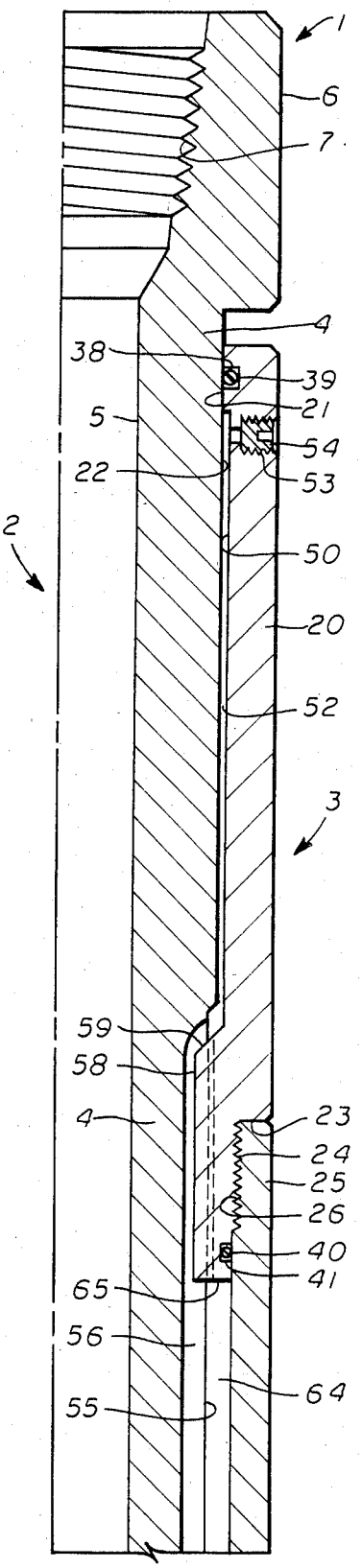
FIGS. 1A-1D are successive portions, in quarter section, along the length of a single acting hydraulic fishing jar showing a preferred embodiment of this invention in an initial or starting position.

Referring to the drawings, and particularly to FIGS. 1A-1D, inclusive, there is shown a single acting fishing jar 1 which is of substantial length necessitating that it be shown in four successive longitudinally broken quarter sectional views, viz. FIGS. 1A, 1B, 1C and 1D. Each of these views is shown in longitudinal section extending from the center line of the jar to the outer periphery thereof. Fishing jar 1 comprises inner tubular mandrel 2 telescopingly supported inside outer tubular housing 3. Mandrel 2 and housing 3 each consist of a plurality of segments or parts which must be described in further detail.

Mandrel 2 consists of an upper tubular portion 4 (in FIGS. 1A and 1B) having an inner longitudinal passage 5 extending therethrough. The upper end of upper portion 4 is enlarged as indicated at 6 and is internally threaded at 7 for connection to a drill string or the like. The lower end of mandrel portion 4 is provided with a counterbore ending in internal shoulder 8 and internally threaded as indicated at 9.

An intermediate portion of mandrel 2 consists of tubular sleeve member 10 (in FIGS. 1B and 1C) which has its upper end threaded as indicated at 11 for connection inside threaded portion 9 of member 4 with the upper end portion abutting shoulder 8. The lower end of sleeve member 10 is threaded externally as indicated at 12 (FIG. 1C) and is provided with an internal bore or passage 13 which is a continuation of passage 5 in mandrel portion 4. The lower end of mandrel 2 consists of tubular member 14 (in FIGS. 1C and 1D) which is provided with a counterbore ending in shoulder 15 and internally threaded as indicated at 16. Tubular portion 14 is threadedly assembled on the lower end of tubular member 10 with the lower end thereof abutting shoulder 15.

The lower end portion of tubular member 14 is of reduced diameter as indicated at 17 defining an annular stop shoulder 18. Tubular portion 14 has an internal longitudinal passage 19 which is an extension of passages 5 and 13. The three portions 4, 10 and 14 are threadedly assembled, as shown, into a single tubular mandrel 2 which is longitudinally movable inside tubular housing 3 as will be subsequently described.

Tubular housing 3 is formed in several sections, for purposes of assembly, somewhat similarly to mandrel 2. The upper end of tubular housing 3 consists of tubular member 20 (in FIG. 1A) which has a smooth inner bore 21 at its upper end in which the exterior surface 22 of upper mandrel tubular member 44 is positioned for longitudinal sliding movement. The lower end portion of tubular housing member 20 has a portion of reduced diameter forming an annular shoulder 23 and having an exterior threaded portion 24.

Tubular housing 3 is provided with an intermediate tubular portion 25 (in FIGS. 1A and 1B) which is internally threaded as indicated at 26 at its upper end for threaded connection to the threaded portion 24 of tubular housing member 20. The upper end of the intermediate tubular portion 25 abuts shoulder 23 when the threaded connection is made up tight. The lower end portion of tubular member 25 has a portion of reduced diameter (FIG. 1B) forming shoulder 27 and externally threaded as indicated at 28.

The lower portion of tubular housing 3 consists of tubular member 29 (in FIGS. 1B, 1C and 1D) which is internally threaded as indicated at 30 at its upper end for threaded connection to the threaded portion 28 of intermediate housing portion 25. The upper end of the lower tubular housing portion 29 abuts shoulder 27 when the threaded connection is made up tight. The lower end of tubular housing portion 29 is internally threaded as indicated at 31 (in FIG. 1D).

At the lower end of tubular housing 3, there is provided an elongated tubular connecting member or sub 32 which is externally threaded, as indicated at 33, at its upper end and has a shoulder 34 against when the lower end of tubular housing member 29 abuts when the threaded connection 31/33 is made up tight. Connecting sub 32 has an inner longitudinal passage 35 which is a continuation of the passages through mandrel 2 and which also communicates with the annular space between mandrel portion 14 and the inner surfaces of housing portion 29 and sub 32. The lower end of sub 32 is of reduced diameter as indicated at 36 and has a threaded surface 37 for connection to a fish, or the like, for operation as a fishing jar.

As has already been noted, the mandrel 2 and housing 3 are each formed of several threadedly connected sections for purposes of assembly. Mandrel 2 is arranged for sliding movement inside housing 3. The apparatus will be charged with a suitable operating fluid, e.g. hydraulic fluid, as will be subsequently described, and it is therefore necessary to provide seals against leakage from several points of assembly and also from the points of sliding engagement between mandrel 2 and housing 3.

As previously noted, the exterior surface of the upper mandrel portion 4 has a sliding fit in the bore 21 of the upper tubular portion 20 of housing 3. Tubular member 20 is provided with an internal annular groove 38 in which there is positioned an O-ring 39 which seals that sliding joint against leakage of hydraulic fluid. The threaded connection between tubular housing portions 20 and 25 is sealed against leakage by an O-ring 40 (in FIG. 1A) which is positioned in external peripheral groove 41 in the lower end of tubular housing member 20. The threaded connection between tubular housing members 25 and 29 is similarly sealed against fluid leakage by an O-ring 42 (in FIG. 1B) which is positioned in peripheral groove 43 in the lower end portion of housing member 25. The threaded connection between the lower end of tubular housing member 29 and connecting sub 32 is similarly sealed against leakage of fluid by O-ring 44 (in FIG. 1D) positioned in annular groove 45 in the upper end of sub 32.

Similar seals are provided to prevent leakage through the threaded joints connecting the several sections of mandrel 2. The threaded connection between upper tubular portion 4 and intermediate tubular portion 10 of mandrel 2 is sealed against leakage by O-ring 46 (in FIG. 1B) which is positioned in inner annular groove 47 in the lower end portion of the upper tubular mandrel member 4. The threaded connection between intermediate tubular mandrel member 10 and lower tubular mandrel member 14 is similarly sealed against leakage by O-ring 48 (in FIG. 1C) which is positioned in inner circumferential groove 49.

The space between the inner bore of the various components of housing 3 and the external surface of mandrel 2 provides an enclosed chamber and passages for flow of hydraulic fluid (or other suitable operating fluid) through this fishing jar. Various additional components are provided as will be subsequently described. At the upper end of tubular housing member 20, the space between the inner bore 50 thereof and the external surface 22 of mandrel tubular member 4 provides an annular space or chamber 52. The upper end of chamber 52 is provided with a threaded opening 53 in which a threaded plug member 54 is secured. Threaded opening 53 provides for the introduction of hydraulic fluid (or other suitable operating fluid) as will be subsequently described.

Figure 2:
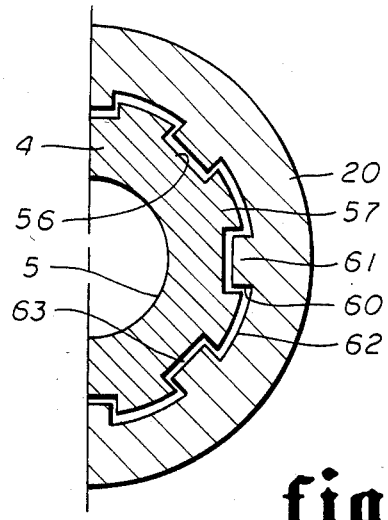
FIG. 2 is a view in half cross section of the fishing jar taken on the section line 2—2 of FIG. 5B.

The exterior surface of tubular mandrel member 4 is of slightly reduced diameter at the lower end portion 55 thereof and is provided with a plurality of longitudinally extending grooves 56 with splines 57 therebetween (in FIGS. 1A and 2). The lower end portion of housing tubular member 20 is provided with an inner bore 58 of reduced diameter forming an upper beveled shoulder 59 and having a plurality of longitudinally extending grooves 60 therein circumferentially spaced to define a plurality of splines 61 which fit into grooves 56 in upper tubular mandrel member 4 (in FIGS. 1A and 2).

The grooves 56 and 60 in tubular housing member 20 and in tubular mandrel member 4 are of greater depth than the height of the splines 57 and 61 positioned in those grooves. As a result, passages are provided which extend longitudinally of the respective grooves in mandrel member 4 and housing member 20 as indicated at 62 and 63 (in FIGS. 1A and 2).

The arrangement of longitudinally extending splines and grooves in tubular housing member 20 and on tubular mandrel member 4 provides a guide for longitudinal movement of mandrel 2 in housing 3 without permitting rotary movement therebetween. The passages 62 and 63 in the clearance between the splines and grooves provide for flow of hydraulic fluid between chamber 52 and the lower portions of the apparatus as will be subsequently described.

Figure 1B:
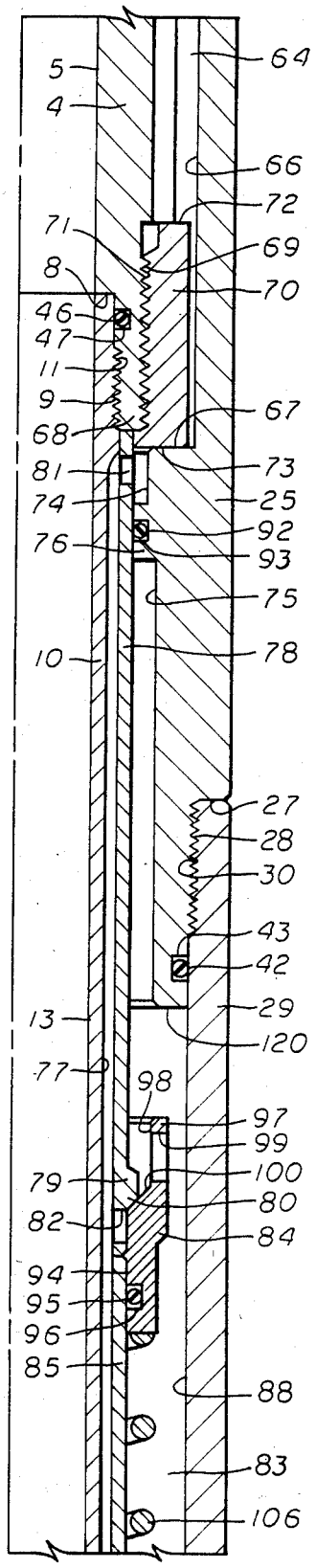

In FIG. 1B, it is seen that the clearance between tubular housing member 25 and mandrel member 4 is such that there is provided a hydraulic chamber 64 of substantially enlarged size relative to hydraulic chamber 52 and communicating therewith. The lower end of tubular housing member 20 provides an anvil surface 65 which is utilized when this apparatus jars in an upward direction for fishing an object from a well. The inner surface 66 of tubular housing member 25 constitutes a counterbore which produces an internal circumferential shoulder 67 at the lower end of hydraulic chamber 64 which is a stop limiting downward movement of the mandrel into the housing.

The lower end portion 68 of mandrel member 4 has the external surface thereof threaded as indicated at 69. A hollow cylindrical hammer 70, having internal threads 71, is threadedly secured on the threaded portion 69 of tubular mandrel member 4 and may be secured against loosening during operation by a set screw or the like (not shown). The upper end portion 72 of hammer 70 is engageable during operation with the anvil surface 65 on housing member 20. The lower hammer surface 73 of hammer member 70 engages stop shoulder 67 at the limit of downward operation of the apparatus. Housing member 25 has an upper counterbore 74 and a lower counterbore 75 which end a short distance apart and define an intermediate portion 76 forming a guide for movement of the mandrel.

Figure 1C:
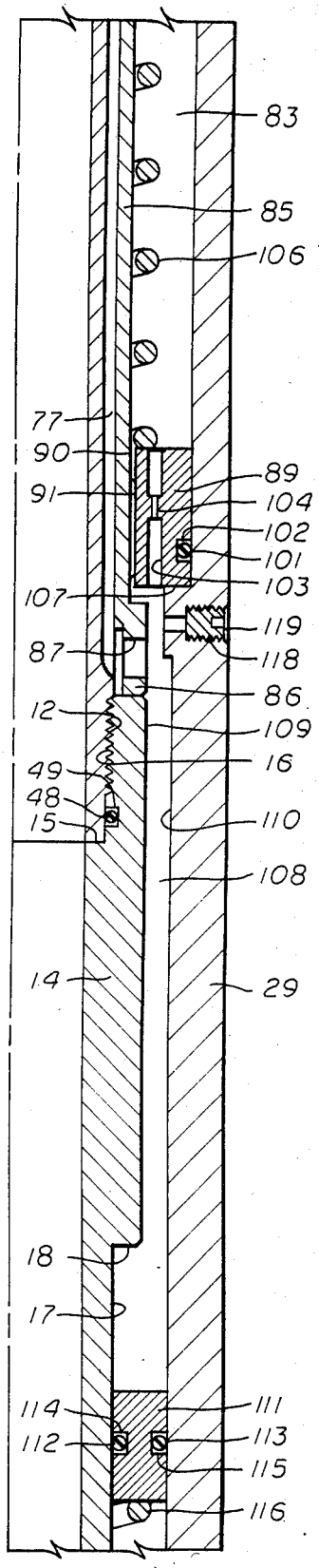
Figure 1:
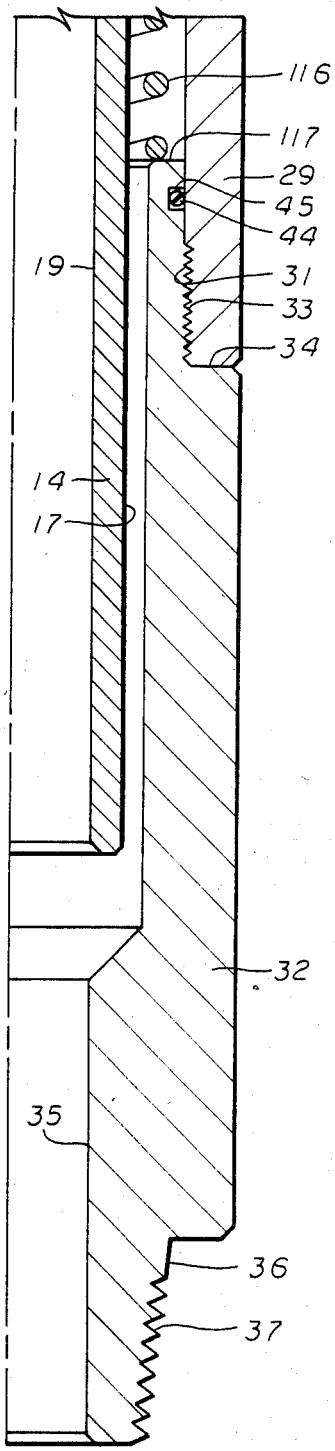
Figure 3:
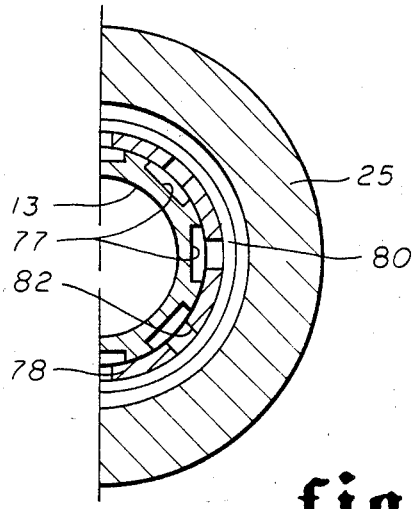
FIG. 3 is a view in half cross section of the fishing jar taken on the section line 3—3 of FIG. 5B.
Figure 4:
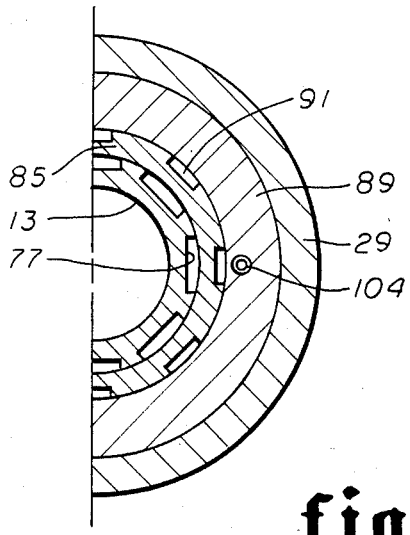
FIG. 4 is a view in half cross section of the fishing jar taken on the section line 4—4 of FIG. 5C.

Tubular mandrel portion 10 is provided with a plurality of longitudinally extending grooves 77 (in FIGS. 1B, 1C and 3). Grooves 77 provide flow passages for flow of hydraulic fluid as will be subsequently described. Tubular sleeve member 78 fits tightly on tubular mandrel member 10 overlying the upper end portions of grooves 77. The lower end portion of sleeve member 78 has an enlarged portion 79 with a beveled surface forming a valve seat 80 (in FIGS. 1B and 3).

Tubular sleeve member 78 is provided with apertures 81 at its upper end which open from counterbore 74 into grooves 77. It is also provided with apertures 82 which open from the lower ends of grooves 77 into hydraulic chamber 83, controlled by a tripping valve 84, as described below. The upper end of tubular sleeve member 78 abuts the lower end of tubular mandrel member 4.

The lower end of tubular member 78, below valve seat 80, abuts the upper end of a tubular sleeve member 85 which fits tightly over the mandrel member 10 covering the lower end portions of grooves 77. Sleeve members 78 and 85 therefore enclose the grooves 77 and define a system of longitudinally extending passages. The lower end of sleeve 85 is enlarged, as indicated as 86 and has a plurality of apertures 87 opening from the lower ends of grooves or passages 77.

The inner surface 88 of housing member 29 and the outer surfaces of tubular sleeve members 78 and 85 are spaced apart to define a hydraulic chamber 83. The outer surface of sleeve member 85 is a smooth cylindrical surface permitting free movement of a pressure piston 89 and a tripping valve 84 supported therebetween. The lower end portion of sleeve member 85 is enlarged, as indicated at 90, and is provided with slots 91 in the outer surface thereof. The upper end of hydraulic chamber 83, at guide portion 76 of housing member 25 is sealed by O-ring 92 positioned in annular groove 93.

Approximately midway of the length of hydraulic chamber 83, there is provided a tripping valve 84 (in FIGS. 1B and 5C) for controlling the release of hydraulic fluid from chamber 83. Tripping valve 84 is a tubular valve member having a smooth cylindrical bore 94 fitting the outer surface of tubular sleeve 85 for sliding movement thereon. Valve member 84 is sealed on its inner surface by O-ring 95 fitting in annular groove 96. Valve member 84 has an enlarged tubular extension 97 having a counterbore 98. Apertures 99 open from counterbore 98 into hydraulic chamber 83. Valve member 84 has a beveled valve seat surface 100, connecting smooth cylindrical bore 94 and counterbore 98, which has an initially closed position against valve seat 80.

An annular pressure piston 89 is positioned at the lower end of hydraulic chamber 83 (in FIG. 1C). Piston 89 has a sliding fit between tubular member 85 and the inner surface 88 of housing member 29 and is sealed on the outside by O-ring 101 positioned in groove 102. Piston 89 has a longitudinal passageway 103 with and orifice 104 therein. There are grooves 91 in an enlarged portion of sleeve 85 over which piston 89 slides which permit flow of hydraulic fluid. A coil spring 106 is positioned between piston 89 and tripping valve member 84 which urges valve member 84 to a seated position and hydraulic piston member 89 toward an initial position seated on shoulder 107.

Below the shoulder 107 on which pressure piston 89 rests, there is a fluid chamber 108 (in FIG. 1C) formed by the outer surface 109 of mandrel portion 14 and the inner surface 110 of housing portion 29. The lower end of fluid chamber 108 is closed by annular piston 111 positioned for sliding movement therein. Piston 111 is sealed against fluid leakage by O-rings 112 and 113 positioned in grooves 114 and 115, respectively. Piston 111 abuts and is urged upward by spring 116 which is supported on the upper end 117 of connecting sub 32. A threaded opening 118, closed by plug 119, provides for filling chamber 108 with fluid.

OPERATION

The apparatus described above is a single acting hydraulic fishing jar which can be used to apply upwardly directed impact or jarring forces to an object stuck in a well, i.e. a "fish". In the operation of this fishing jar for jarring in the upward direction, the drill pipe is stretched by an axial tensile pull applied at the surface. The application of this tensile force is resisted by the tripping mechanism of the jar long enough for the pipe to stretch and store potential energy. When the jar reaches a tripping position, the stored energy in the stretched pipe is converted to kinetic energy which causes the impact surfaces, i.e. hammer and anvil, of the jar to move together and strike at a high velocity, thus applying a very high impact force. When the upward stretch of the pipe is released, the jar is recocked to its initial or starting position. The apparatus described above is a novel fishing jar which operates in the upward direction and is tripped hydraulically. The principle of operation and the sequence of movement of the various parts will be described below to provide a clearer understanding of the invention.

THE INITIAL OR STARTING POSITION

When the fishing jar 1 is assembled, as described above, it is filled with a hydraulic fluid through opening 53 in the upper tubular housing member 20 and opening 118 in the lower housing member 29. The hydraulic fluid used is preferably a non-compressible fluid since the apparatus operates utilizing the leakage of fluid past the pressure piston. With certain adjustments in operating clearances, the apparatus can be operated using the well drilling fluid. While non-compressble fluids are preferred, it is possible to use a compressible hydraulic fluid or a high pressure gas, but this would require a longer tool in order to allow for the additional travel required to pressurize a compressible fluid.

When the hydraulic fluid is introduced into the fishing jar 1 through openings 53 and 118, it flows to the bottom of hydraulic fluid chamber 108 which is closed by pressure balancing piston 111. The hydraulic fluid fills the space in hydraulic chamber 108 and hydraulic chamber 83 which is located between the pressure piston 89 and O-ring seal 92. The hydraulic fluid also fills the various passages including passage 77 and counterbore 74 leading the hydraulic fluid chamber 64. This chamber is filled with fluid on up into hydraulic fluid chamber 52 in which the fluid extends up to the level of the filling opening 53.

The apparatus can be inclined somewhat to work out air bubbles in the filling so that it is completely filled with fluid up to the opening 53. At this point, filling plugs 54 and 119 are inserted and the apparatus is ready for use. The pressure balancing piston 111 allows for thermal expansion of the fluid and also allows the hydrostatic pressure of the fluid in the well bore which surrounds the jar to keep the fluid in the jar under sufficient pressure to cause it to complete its path of flow from one section of the apparatus to another.

In the embodiment of the invention as shown in FIGS. 1A–1D, the apparatus is in the initial or starting position from which it can be moved upward to produce an upward jarring force to facilitate loosening a "fish". In this initial position, the hammer 70 is positioned against stop shoulder 73. The pressure piston 89 is held against shoulder 107 by the force of spring 106. In this position, the spring 106 also holds tripping valve 84 in closed position against valve seat 80 (in FIG. 1B). The apparatus will be first described in providing an upward jarring action for loosening a "fish".

UPWARD JARRING

When this fishing jar is operated in an upward direction from the initial position shown in FIGS. 1A–1D, the drill string to which the upper end 6 of mandrel 2 is attached is stretched upward and placed under the desired degree of tension. As the drill string is stretched upward, it places the mandrel 2 under tension and moves it to the limit permitted by the tripping mechanism. The upward movement of mandrel 2 from the initial or starting position shown in FIGS. 1A–1D, first brings the shoulder of the enlarged portion 86 of sleeve member 85 into engagement with the bottom end of pressure piston 89. In this position, the shoulder of enlarged portion 86 and piston 89 function as a valve closing the end of chamber 83 which prevents the flow of fluid from the chamber except through passage 104. This initial upward movement by mandrel 2 does not yet start to actuate tripping valve 94 or apply any pressure to the fluid in the system.

As mandrel 2 moves further upward, the shoulder moves pressure piston 89 upward to apply pressure to the fluid in chamber 83. Further movement of pressure piston 89 upward, by movement of mandrel 2, results in the resistance to movement building up because of the relative incompressability of the hydraulic fluid which fills chamber 83. When pressure piston 89 moves upward, pressure is applied to the fluid in chamber 83 and a very high hydraulic pressure is rapidly achieved. The fluid can not flow past O-ring seal 92 or out through tripping valve 94 which is closed at this stage of operation. The fluid in chamber 83 can only leak very slowly through passage 103 and orifice 104 in pressure piston 89. This permits upward movement of piston 89 at a rate determined by the amount of fluid which has leaked from chamber 83 through passage 103. During this upward movement, the hydraulic fluid in chamber 83 is maintained under a very high pressure which represents the pressure created by the tension applied to mandrel 2 from the drilling string.

Further upward movement of mandrel 2 moves the pressure piston 89 relative to housing portion 29 and relative to the O-ring seal 92. Such movement is permitted by the slow leakage of fluid from chamber 83 through orifice 104 into chamber 108 and through passages 77 into chamber 64 beyond the O-ring seal 92. After predetermined upward movement, the apparatus reaches the position where the end of the enlarged portion 97 of tripping valve 84 engages the lower end 120 of housing member 25. The position just described is an intermediate position, not shown in the drawings, just prior to tripping the valve.

At this point, the hydraulic fluid in chamber 83 is under a very high pressure and is resisting movement of piston 89 which provides the resistance to movement of mandrel 2 allowing the build up of a substantial amount of tension in the mandrel and in the drill string. When mandrel 2 moves further upward, the movement of tripping valve 84 along with the mandrel is restrained and valve surface 100 moves away from valve seat 80 to open tripping valve 84. In this position, the end of valve member enlarged portion 97 abuts the lower end 120 of housing member 25. Tripping valve 84 is open and fluid is free to flow through apertures 99 and 82 and the various passages communicating with the other fluid chambers 108, 64 and 52. When tripping valve 84 is opened, the fluid in chamber 83 is released to flow to the other fluid chambers, primarily chambers 108 and 64, and the pressure in chamber 83 drops substantially to the level of the hydrostatic pressure in the well bore. This pressure drop removes the resistance to upward movement by pressure piston 89 and permits that piston and mandrel 2 to move rapidly for the remaining length of the jarring stroke.

Figure 5A:
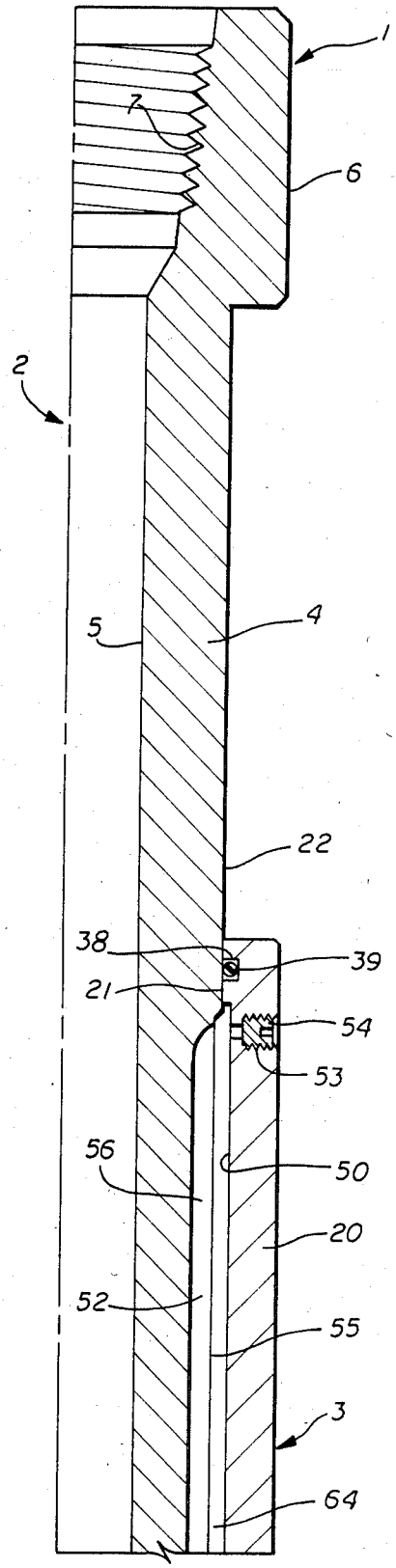
FIGS. 5A-5D correspond substantially to FIGS. 1A-1D showing the position of the apparatus after the tripping valve has been opened and the mandrel has moved to the fully actuated position with the hammer striking the anvil portion thereof.
Figure 5B:
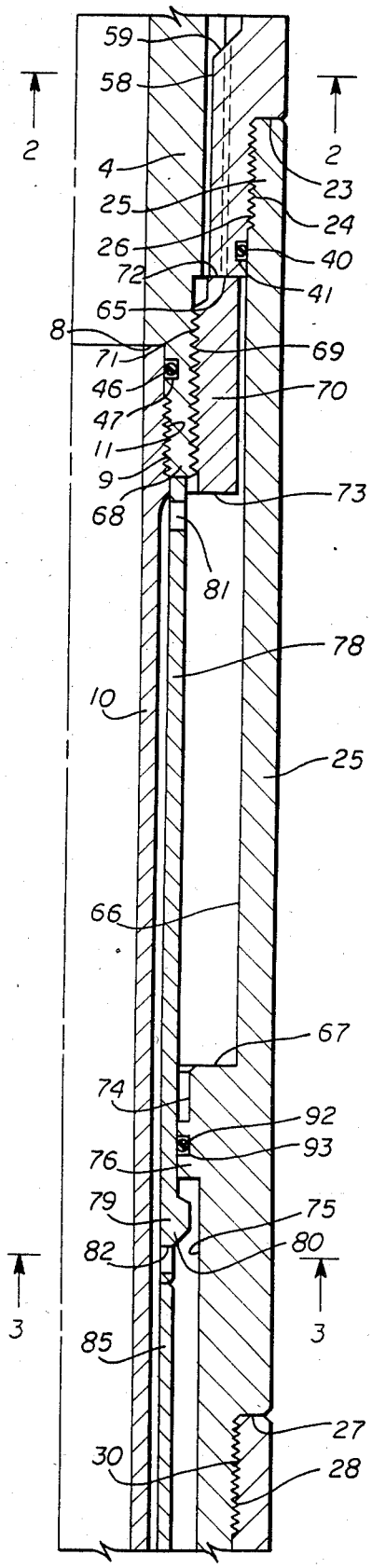
Figure 5C:
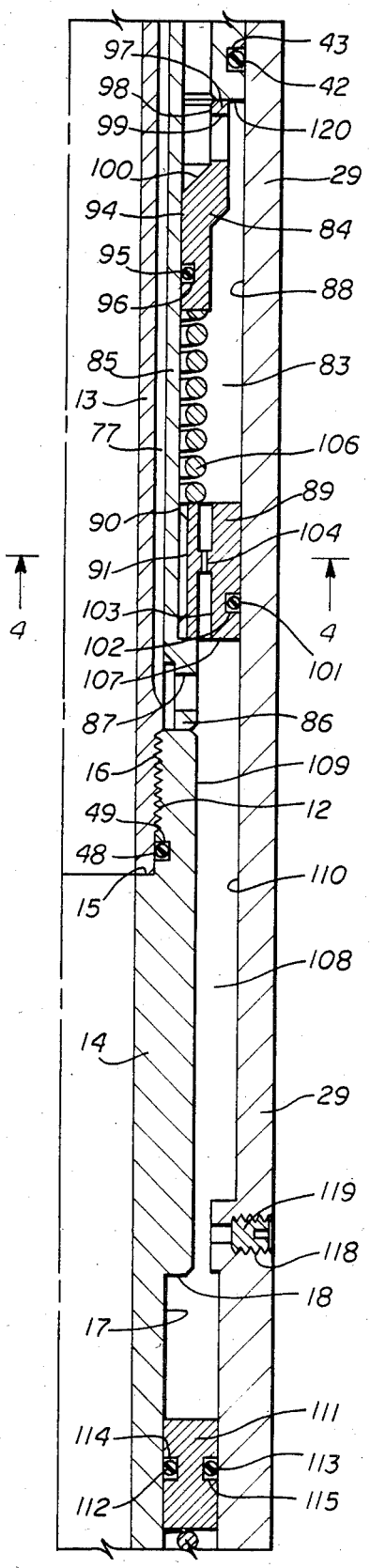
Figure 5D:
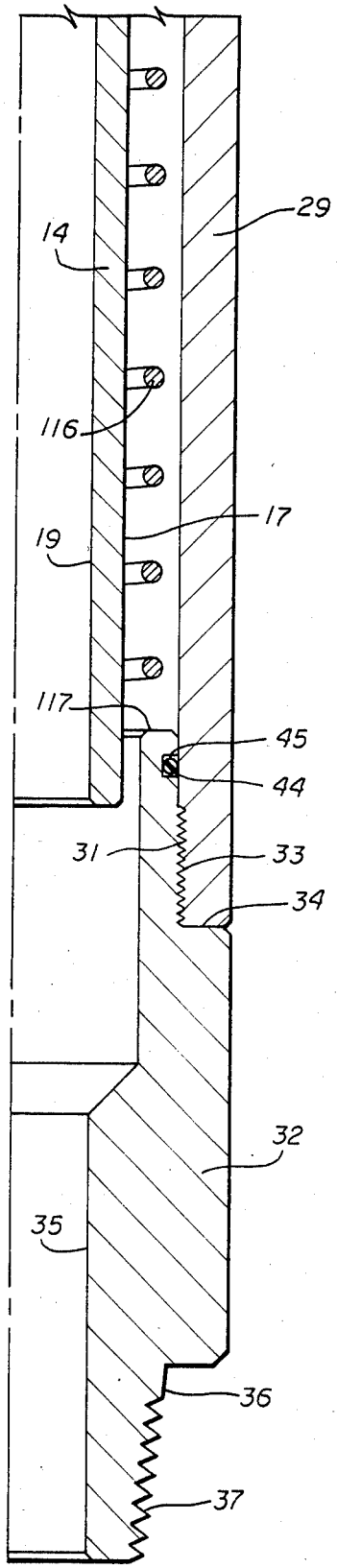

This last rapid movement is the movement between the position where the tripping valve 84 starts to open and the position shown in FIGS. 5A to 5D. This movement is one in which the tripping valve has been opened wide, as seen in FIGS. 5B and 5C, and mandrel 2 has moved upward to the point where the upper surface 72 of hammer 70 has engaged anvil shoulder 65 with a hammer or impact blow. This last rapid movement releases the tensile energy in mandrel 2 and the drill string in the form of kinetic energy moving hammer 70 at a very high speed into jarring impact with anvil shoulder 65. At the point of engagement of hammer 70 with anvil shoulder 65, the apparatus has reached the point of maximum upward movement. The movement of mandrel 2 is thus limited in an upward direction by engagement of hammer 70 with anvil shoulder 65 and in a downward direction by engagement of hammer 70 with stop shoulder 67, as previously described.

RECOCKING AFTER UPWARD JARRING

After reaching the upward limit of movement shown in FIGS. 5A to 5D, the apparatus is recocked for further use by releasing the tension of the drill string to allow the mandrel 2 to move back to the initial or starting position of FIGS. 1A–1D. As mandrel 2 moves downward, hammer 70 moves away from anvil surface 65. Pressure piston 89 moves downward along with mandrel 2. Fluid chamber 83 is filled with hydraulic fluid forced by the downward movement of pressure piston 89 through opening 87, passages 77, apertures 82, and the open tripping valve 84. When the downward movement of the mandrel moves tripping valve 84 away from the end 120 of housing member 25, tripping valve 84 closes. Continued downward movement of mandrel 2 causes pressure piston 89 to contact shoulder 107 and open the valve formed by piston 89 and the shoulder 86 of sleeve member 85. Hydrostatic pressure acting on piston 111 forces fluid through the open valve into chamber 83 to ensure that it is full of fluid. Further downward movement of the mandrel allows the fluid to distribute between chamber 108 and chambers 52 and 64 until the apparatus has returned to the initial or starting position shown in FIGS. 1A to 1D where further downward movement is stopped by engagement of hammer 70 with stop shoulder 67.

While this invention has been described fully and completely with emphasis on a single preferred embodiment, it should be understood that, within the scope of the appended claims, this invention may be practiced otherwise than as specifically set forth in this specification.

I claim:

1. A fluid actuated fishing jar comprising a pair of tubular members positioned in telescoping relation for limited longitudinal movement of one relative to the other and adapted for connection of one tubular member to a drill pipe and the other tubular member to an object to be dislodged from a well, means defining a chamber between said tubular members, piston means closing said chamber and operatively connected to one of said tubular members for movement thereby, a substantially incompressible hydraulic fluid filling said chamber and resisting relative movement of said piston means, said piston means being movable in one direction to apply pressure to fluid in said chamber upon relative movement between said tubular members in one direction, one of said tubular members having a valve opening positioned between said piston means and the end of said chamber, valve means initially closing said valve opening, fixed abutment means on the other tubular member operatively engagable with said valve means upon a first predetermined relative movement of said piston means in said one direction, said valve means being movable to open the same on engagement with said abutment means to release fluid from said chamber upon said first predetermined relative movement of said piston means in said one direction and thereby reduce substantially the resistance to further relative movement of said piston means and movement of said tubular members therewith, means permitting a relatively minute flow of fluid from said chamber during said first predetermined relative movement of said piston means, and hammer and anvil means engagable with a jarring impact upon said further relative movement of said tubular members.

2. A fishing jar according to claim 1 in which said hammer and anvil means include a hammer member on one tubular member and an anvil member on the other tubular member engagable with an impact force in one direction after a second predetermined relative movement of said tubular members in said one direction.

3. A fishing jar according to claim 2 in which said fluid flow permitting means comprises at least one passageway associated with said piston means and operable during said first predetermined relative movement of said tubular members to release fluid from said chamber.

4. A fishing jar according to claim 3 in which said fluid flow permitting passageway is located in said piston means.

5. A fishing jar according to claim 4 in which said valve means comprises a valve member supported on one of said tubular members and closing said valve port, and resilient means cooperable with said valve member urging the same to an initially closed position.

6. A fishing jar according to claim 1 in which said valve means comprises a valve member supported on one of said tubular members and closing said valve port, and resilient means cooperable with said valve member urging the same to an initially closed position.

7. A fluid actuated fishing jar comprising inner and outer tubular members positioned in telescoping relation for limited longitudinal movement of one relative to the other and radially spaced to define a longitudinally extending chamber, sealing means between said tubular members defining one end of said chamber, piston means positioned between said inner and outer tubular members spaced longitudinally from said sealing means, and moveable reative thereto, forming the other end of said chamber, a substantially incompressible hydraulic fluid filling said chamber and resisting relative movement of said piston means, means for moving said piston means toward said sealing means in response to relative movement between said tubular members in one direction, means comprising a valve member on one of said tubular members and a fixed abutment on the other tubular member engagable therewith effective upon a first predetermined relative movement of said piston means toward said sealing means, and a like relative movement of one of said tubular members relative to the other, to permit rapid flow of fluid from said chamber and thereby reduce substantially the resistance to further relative movement of said piston means and movement of said tubular members therewith, and hammer and anvil means engagable with a jarring impact upon said further relative movement of said tubular members.

8. A fishing jar according to claim 7 in which said inner and outer tubular members comprise an inner tubular mandrel and an outer tubular housing.

9. A fishing jar according to claim 7 in which said inner tubular member includes a plurality of equally spaced longitudinally extending splines and grooves on the external surface thereof, said outer tubular member includes a plurality of equally spaced longitudinally extending splines and grooves in the inner surface thereof, the splines on each tubular member being of a size and shape fitting the grooves on the other tubular member, and said splines and grooves being operable to permit longitudinal movement of said tubular members while preventing relative rotational movement therebetween.

10. A fishing jar according to claim 7 in which said hammer and anvil means include a hammer member on one tubular member and an anvil member on the other tubular member engagable with an impact force in one direction after a second predetermined relative movement of said tubular members in said one direction.

11. A fishing jar according to claim 7 in which said inner tubular member includes a plurality of equally spaced longitudinally extending splines and grooves on the external surface thereof, said outer tubular member includes a plurality of equally spaced longitudinally extending splines and grooves in the inner surface thereof, the splines on each tubular member being of a size and shape fitting the grooves on the other tubular member, said splines and grooves being operable to permit longitudinal movement of said tubular members while preventing relative rotational movement therebetween, said hammer and anvil means include a hammer member on one tubular member an an anvil member on the other tubular member engagable with an impact force in one direction after a second predetermined relative movement of said tubular members in said one direction, and said hammer member having a plurality of equally spaced splines and grooves fitting the splines and grooves of said outer tubular member for longitudinal movement therein.

12. A fishing jar according to claim 7 in which said valve opening is in said inner tubular member, and a valve member surrounds and is slidably movable on said inner tubular member to control said valve opening to release fluid from said chamber, said valve member being movable with said inner tubular member on movement thereof relative to said outer tubular member.

13. A fishing jar according to claim 12 in which said tubular members enclose a second chamber communicating with said first named chamber through said valve opening, and said valve member opening movement is operable to release fluid to flow from said first named chamber to said second chamber.

14. A fishing jar according to claim 13 in which said outer tubular member includes means engagable with said valve member on said first predetermined relative movement of said inner tubular member to move said valve member to an open position.

15. A fishing jar according to claim 7 in which said means for moving said piston means comprises abutment means on one of said tubular members engageable therewith.

16. A single acting hydraulic fishing jar for connection in a tubular earth drilling string comprising outer and inner tubular members positioned in telescoping relation for limited longitudinal movement of one relative to the other, means including said tubular members and seal means cooperable therewith defining an outer fluid-containing chamber therebetween, a further seal means and piston means positioned in spaced relation for movement longitudinally in said outer chamber and spaced apart to define an inner chamber within said outer chamber, means for moving said piston means toward said further seal means in response to relative movement of said tubular members in one direction, a substantially incompressible hydraulic fluid filling said outer and inner chambers and resisting relative movement of said piston means toward said further seal means, means permitting relative movement between said piston means and said further seal means when said chambers are filled with fluid, including means permitting a minute flow of fluid for said inner chamber, at least one passageway opening from a point intermediate said piston means and said further seal means for flow of fluid from said inner chamber to said outer chamber, valve means in said inner chamber closing said opening to said passageway, valve actuating means comprising fixed abutment means on said outer tubular member operatively engagable with said valve means and operable upon predetermined relative movement of said tubular members in said one direction to open said valve means to permit flow of fluid from said inner to said outer chamber to reduce substantially the resistance to relative movement of said tubular members, and hammer and anvil means engagable with a jarring impact upon further relative movement of said tubular members subsequent to opening said valve means.

17. A hydraulic fishing jar according to claim 16 in which said inner tubular member includes a plurality of equally spaced longitudinally extending splines and grooves on the external surface thereof, said outer tubular member includes a plurality of equally spaced longitudinally extending splines and grooves in the inner surface thereof, the splines on each tubular member being of a size and shape fitting the grooves on the other tubular member, and said splines and grooves being operable to permit longitudinal movement of said tubular members while preventing relative rotational movement therebetween.

18. A hydraulic fishing jar according to claim 16 including a passageway extending from one end portion to the other end portion of said outer chamber, around said inner chamber, to permit fluid flow therebetween.

19. A hydraulic fishing jar according to claim 16 in which said tubular members include a hammer member on one tubular member and an anvil member on the other tubular member engagable with an impact force in one direction after a second predetermined relative movement in one direction, said piston means comprises an annular piston member surrounding said inner tubular member and fitting within said outer tubular member, said piston member being movable relative to each of said tubular members, a passageway in said piston member providing a relatively minute flow of fluid from said inner to said outer chamber upon said relative movement of said piston members, said valve means comprising a valve member held in closing engagement at least in part by fluid pressure in said chamber, spring means cooperable with said valve member urging the same closed position, and said outer tubular member including means engagable with said valve member on said first predetermined relative movement of said inner tubular member to move said valve member to an open position.

20. A hydraulic fishing jar according to claim 16 in which said inner tubular member includes a plurality of equally spaced longitudinally extending splines and grooves on the external surface thereof, said outer tubular member includes a plurality of equally spaced longitudinally extending splines and grooves in the inner surface thereof, the splines on each tubular member being of a size and shape fitting the grooves on the other tubular member, said splines and grooves being operable to permit longitudinal movement of said tubular members while preventing relative rotational movement therebetween, said tubular members having spaced concentric walls defining said inner chamber therebetween, said further seal comprising a seal between said tubular members at one end of said chamber permitting longitudinal sliding movement, said piston means comprising an annular piston member positioned in spaced relation for movement longitudinally in said chamber and being of a size and shape having a sliding fit between said concentric walls, said inner tubular member having a shoulder engagable with said piston member to move the same toward said seal in response to relative movement of said tubular members in one direction and providing lost motion between said inner tubular member and said valve member, means permitting relative movement between said piston means when said chamber is filled with fluid and comprising an orifice in said piston member permitting a very small flow of hydraulic fluid past said piston member upon movement thereof by said inner tubular member shoulder, a passageway extending from one end portion to the other end portion of said outer chamber, around said inner chamber, to permit fluid flow therebetween, a valve opening from said inner chamber into said passageway, and said valve means comprising a valve member movable with said inner tubular member and slidable between an open and closed position relative to said valve opening.

* * * * *